US006880356B2

(12) United States Patent
Park et al.

(10) Patent No.: US 6,880,356 B2
(45) **Date of Patent: *Apr. 19, 2005**

(54) SIMULTANEOUS HEATING AND COOLING OPERATION TYPE MULTI-AIR CONDITIONER

(75) Inventors: Jong Han Park, Gwangmyeong-si (KR); Young Min Park, Incheon-si (KR); Chang Seon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/643,911

(22) Filed: Aug. 20, 2003

(65) Prior Publication Data

US 2004/0035133 A1 Feb. 26, 2004

(30) Foreign Application Priority Data

Aug. 24, 2002 (KR) ..... 10-2002-0050320

(51) Int. Cl.[7] ..... F25B 13/00; F25B 41/04

(52) U.S. Cl. ..... 62/324.6; 62/324.1; 62/160

(58) Field of Search ..... 62/324.6, 324.1, 62/160, 278, 197, 504, 510, 335, 498, 513

(56) References Cited

U.S. PATENT DOCUMENTS 5,297,392 A * 3/1994 Takata et al. ..... 62/160
5,309,733 A * 5/1994 Hayashida et al. ..... 62/278

* cited by examiner

*Primary Examiner*—Chen Wen Jiang
(74) *Attorney, Agent, or Firm*—Greenblum & Bernstein, P.L.C.

(57) ABSTRACT

Disclosed is a multi-air conditioner comprising: an outdoor unit installed at an outdoor location and exchanging heat with an outdoor air, a plurality of indoor units installed at respective indoor rooms and provided therein with an indoor heat exchanger and an electronic expansion valve, and a distributor provided between the outdoor unit and the indoor units, for selectively guiding the refrigerant according to the operation mode. The outdoor unit is comprised of a compressor, a refrigerant flow control part for controlling a flow path of a compressed refrigerant according to an operation mode, an outdoor heat exchanger exchanging heat with the outdoor air, and a pipe part connecting the elements of the outdoor unit and guiding the refrigerant to the distributor. The distributor guides the refrigerant selectively to the outdoor unit and the indoor units according to the operation mode.

30 Claims, 10 Drawing Sheets

SIMULTANEOUS HEATING AND COOLING OPERATION TYPE MULTI-AIR CONDITIONER

This application claims the benefit of the Korean Application No. P2002-0050320 filed on Aug. 24, 2002, which is hereby incorporated by reference.

BACKGROUND OF THE INVENTION

1. Field of the Invention

The present invention relates to a multi-air conditioner, and more particularly, to a simultaneous heating and cooling operation type multi-air conditioner.

2. Discussion of the Related Art

Generally, an air conditioner is an apparatus for cooling or heating an indoor space such as a residential space, office, restaurant and the like, and is provided with a compressor and a heat exchanger to cool or heat indoor space by flowing refrigerant.

The air conditioner has been advanced to the development of a multi-air conditioner performing the heating and cooling operations at the same time so as to maintain more pleasant indoor environment without being affected by an outdoor temperature or environment, so that it becomes possible to cool or heat all the rooms in the same operation mode.

In the meanwhile, the multi-air conditioner is comprised of one outdoor unit, and a plurality of indoor units each being connected to the outdoor unit and being installed every room. The multi-air conditioner operates in one of heating mode and cooling mode, thereby heating or cooling the room air.

However, as the indoor space is widened, the indoor structure is complicated and the position or use purpose of each room is diversified, the temperatures of the respective rooms become different. In other words, a room in which a machinery or a computer system is installed shows a higher temperature than other rooms due to heat generated during an operation of the machinery or the computer system.

Accordingly, some rooms may be required to operate in a cooling mode while other rooms may be required to operate in a heating mode. However, the conventional air conditioner has a drawback in that it does not meet such a requirement.

According to the aforementioned necessity, there is being requested a development of a simultaneous cooling and heating type multi-air conditioner in which the rooms needing the cooling operation are operated in the cooling mode and at the same time the rooms needing the heating operation are operated in the heating mode.

Also, in the conventional multi-air conditioner, since refrigerant flowing through an identical position of each pipe in the cooling mode and the heating mode shows states that are different depending on the operation condition, i.e., states that phase and pressure are different, there is a problem in that an excessive safety rate in designing the diameters of the pipes is applied.

SUMMARY OF THE INVENTION

Accordingly, the present invention is directed to a multi-air conditioner that substantially obviates one or more problems due to limitations and disadvantages of the related art.

An object of the present invention is to provide a simultaneous cooling and heating type multi-air conditioner permitting some rooms to be operated in a cooling mode and the remaining rooms to be operated in a heating mode according to an indoor environment of each of the rooms.

Another object of the present invention is to provide a multi-air conditioner whose pipe construction is simplified to thereby simplify the fabrication process and lower the fabrication cost.

A further object of the present invention is to provide a multi-air conditioner allowing a refrigerant having a specific pressure and a specific phase to always flow through each pipe regardless of an operation condition and the flow of the refrigerant to be converted without any delay when the operation mode is converted.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein. There is provided a multi-air conditioner comprising: an outdoor unit installed at an outdoor location, and having therein a compressor, a refrigerant flow control part connected to a discharge outlet of the compressor, for guiding refrigerant according to an operation condition, an outdoor heat exchanger connected with the refrigerant flow control part, and a pipe part connecting the elements; and a plurality of indoor units installed at respective indoor rooms and provided therein with an indoor heat exchanger of which one end is connected with a distributor, and an electronic expansion valve of which one end is connected the indoor heat exchanger and the other end is connected with the distributor, the distributor being provided between the outdoor unit and the indoor units, for selectively guiding the refrigerant introduced from the outdoor unit to the plurality of indoor units according to the operation condition and again guiding the refrigerant passing through the indoor units, to the outdoor unit.

The pipe part includes a first connection pipe of which one end is connected to the refrigerant flow control part and the other end is connected to the distributor in which an indoor heat exchanger is connected between the one end and the other end of the first connection pipe, a second connection pipe of which one end is connected with the refrigerant flow control part, for guiding the compressed refrigerant to the distributor, and a third connection pipe for connecting an absorbing inlet of the compressor with the distributor, the third connection pipe having a mid portion connected to the refrigerant flow control part, for guiding a low pressure/vapor-phase refrigerant to the compressor.

The operation condition comprises: a first mode in which all the indoor rooms are operated in a cooling mode according to the respective states of the indoor rooms; a second mode in which a majority of indoor rooms are operated in the cooling mode and a minority of rooms are operated in a heating mode; a third mode in which all the indoor rooms are operated in the heating mode; and a fourth mode in which a majority of indoor rooms are operated in the heating mode and a minority of indoor rooms are operated in the cooling mode.

The refrigerant flow control part comprises: a first auxiliary connection pipe of which one end is connected with the discharge outlet; a passage control unit of which one end is connected to the other end of the first auxiliary connection pipe, the passage control unit changing the flow of the refrigerant introduced from the first auxiliary connection pipe according to the operation condition; a second auxiliary connection pipe of which one end is connected with the passage control unit and the other end is connected with the first connection pipe; and a third auxiliary connection pipe of which one end is connected with the passage control unit and the other end is connected with the mid portion of the third connection pipe.

The passage control unit guides the refrigerant with changing the position thereof according to the operation condition, and comprises an inner valve having a flow passage formed therein.

The refrigerant flow control part further comprises a delay-preventive unit for allowing the operation of the passage control unit to be performed without a delay.

The delay-preventive unit comprises: a delay-preventive pipe of which one end is connected with a mid portion of the second connection pipe; and a pressure-closing pipe of which one end is connected with the other end of the delay-preventive pipe and the other end is connected with the passage control unit, the pressure-closing pipe guiding a predetermined amount of the refrigerant to an inside of the passage control unit to fix the inner valve such that one side of the inner valve is continuously pressed during the operation of the third or fourth mode.

The second connection pipe is connected to the mid portion of the first auxiliary connection pipe of the refrigerant flow control part, and the passage control unit is comprised of a four-way valve.

The delay-preventive unit comprises: a uniform pressure valve provided on the delay-preventive pipe, for cutting off a low/high pressure refrigerant flowing through the delay-preventive pipe to maintain the pressures of the refrigerants at predetermined levels, respectively during the operation of the first or second mode; and a pressure-lowering auxiliary refrigerant flow pipe of which one end is connected with the other end of the delay-preventive pipe and the other end is connected with the mid portion of the third connection pipe, the pressure-lowering auxiliary refrigerant flow pipe lowering the refrigerant pressure of the pressure-closing pipe such that the inner valve is rapidly moved when the operation is converted from the third or fourth mode to the first or second mode.

The delay-preventive unit comprises: an auxiliary uniform pressure valve provided on a connection part of the auxiliary refrigerant flow pipe and the delay-preventive pipe, the auxiliary uniform pressure valve cutting off a space between the auxiliary refrigerant flow pipe and the delay-preventive pipe to maintain the pressures of the refrigerants at predetermined levels, respectively during the operation of the first or second mode; and a rapid refrigerant flow pipe provided between the uniform pressure valve and the auxiliary uniform pressure valve, for rapidly introducing the refrigerant into the pressure closing pipe such that the inner valve is rapidly moved when the operation is converted from the first or second mode to the third or fourth mode.

The pipe part comprises: a check valve installed on the first connection pipe adjacent to the distributor, for passing the refrigerant toward the distributor only during the first or second mode operation; and a parallel expansion valve installed in parallel with the check valve, for guiding the refrigerant introduced from the distributor to the outdoor heat exchanger only during the third or fourth mode operation, and including an element for expanding the refrigerant.

The expansion element on the parallel expansion pipe is comprised of a heating electronic expansion valve for expanding the refrigerant introduced into the outdoor heat exchanger during the third or fourth mode operation.

Alternatively, the pipe part comprises: a check valve installed on the first connection pipe adjacent to the distributor, for passing the refrigerant only during the first or second mode operation; and a parallel expansion valve installed in parallel with the check valve, for guiding the refrigerant introduced from the distributor to the outdoor heat exchanger only during the third or fourth mode operation, and including an element for expanding the refrigerant.

The expansion element on the parallel expansion pipe is comprised of a heating electronic expansion valve for expanding the refrigerant introduced into the outdoor heat exchanger during the third or fourth mode operation.

The distributor comprises: a guide pipe part for guiding the refrigerant introduced through the first or second connection pipe of the outdoor unit to the indoor units according to the operation mode and guiding the refrigerant introduced from the indoor units to the outdoor unit through the first or third connection pipe; and a valve part installed on the guide pipe part, for controlling a flow of the refrigerant such that the refrigerant is selectively introduced into the respective indoor units according to the operation condition.

The guide pipe part comprises: a high pressure/liquid-phase passage connected with the first connection pipe, for guiding a high pressure/liquid-phase refrigerant between the indoor units and the outdoor unit; a high pressure/vapor-phase passage connected with the second connection pipe, for guiding a high pressure/vapor-phase refrigerant between the indoor units and the outdoor unit; and a low pressure/vapor-phase passage connected with the third connection pipe, for guiding a low pressure/vapor-phase refrigerant between the indoor units and the outdoor unit.

In more detail, the guide pipe part comprises: a high pressure/liquid-phase refrigerant connection pipe of which one end is directly connected with the first connection pipe of the outdoor unit; a high pressure/liquid-phase refrigerant branch pipe having one end which is branched from the high pressure/liquid-phase refrigerant connection pipe according to the number of the indoor units, and the other end connected with the electronic expansion valve of each of the indoor units; a high pressure/vapor-phase refrigerant connection pipe of which one end is directly connected with the second connection pipe of the outdoor unit; a high pressure/vapor-phase refrigerant branch pipe having one end which is branched from the high pressure/vapor-phase refrigerant connection pipe according to the number of the indoor units, and the other end connected with the heat exchanger of each of the indoor units; a low pressure/vapor-phase refrigerant connection pipe of which one end is directly connected with the third connection pipe of the outdoor unit; and a low pressure/vapor-phase refrigerant branch pipe having one end which is branched from the low pressure/vapor-phase refrigerant connection pipe according to the number of the indoor units, and the other end connected with the heat exchanger of each of the indoor units.

The distributor further comprises a liquefaction stop unit installed between the second connection pipe and the low pressure/vapor-phase refrigerant connection pipe, for preventing the high pressure/vapor-phase refrigerant from being liquefied due to a stagnation during the first mode operation.

The liquefaction stop unit comprises: a bypass pipe connecting the second connection pipe with the low pressure/ vapor-phase refrigerant connection pipe, for bypassing the stagnated high pressure/vapor-phase refrigerant during the first mode operation; and an electronic conversion valve installed on the bypass pipe, for converting the high pressure/vapor-phase refrigerant stagnated in the second connection pipe, into the low pressure/vapor-phase refrigerant.

The valve part comprises selection valves respectively installed on the high pressure/vapor-phase refrigerant branch pipe and the low pressure/vapor-phase refrigerant branch pipe, for controlling the flow of the refrigerant such that when the indoor room operates in the cooling model, a valve on the high pressure/vapor-phase refrigerant branch pipe is closed and a valve on the low pressure/vapor-phase refrigerant branch pipe is opened, and when the indoor room operates in the heating mode, each of the valves is opened and closed to the contrary.

According to the aforementioned invention, it is possible to provide a simultaneous cooling and heating type multi-air conditioner in which the cooling operation and the heating operation are performed at the same time. Also, due to the simplified pipe construction, it is possible to allow a refrigerant having a specific pressure and a specific phase to flow through each pipe always regardless of an operation condition and the flow of the refrigerant to be converted without any delay.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

In order to help for understanding of the present invention, a function of a simultaneous cooling and heating type multi-air conditioner will be first described. The multi-air conditioner functions to control air temperature, air humidity, air motion and air cleanliness, etc. to adapt air of a specific space to a usage purpose. For example, it functions to cool or heat an indoor space such as a resident space, an office, a restaurant, etc.

At the time of operating in the cooling mode, the multi-air conditioner compresses a low pressure refrigerant absorbing an indoor heat into a high pressure refrigerant and then radiates heat to airs. On the contrary, at the time of operating in the heating mode, the multi-air conditioner is operated contrary to the above process.

It is noted that the conventional multi-air conditioner uniformly operates all the indoor rooms in the cooling mode or the heating mode, while the inventive simultaneous cooling and heating type multi-air conditioner can change an operation condition depending on the state of each room.

Figure 1:
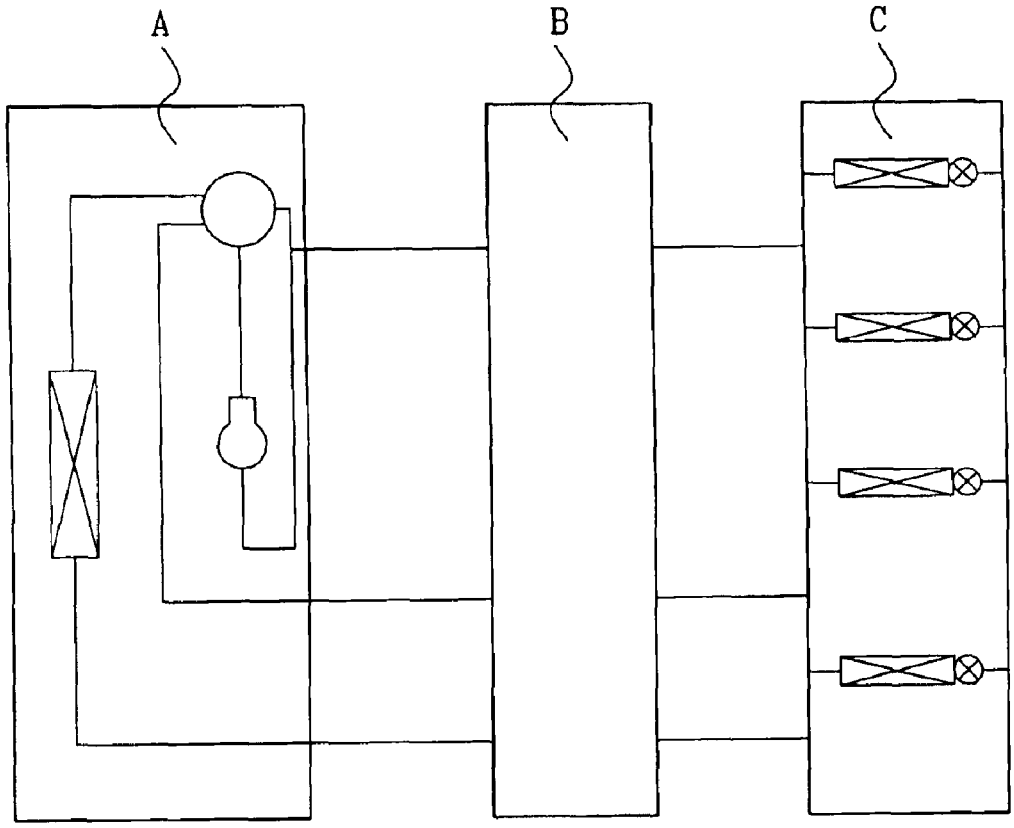
FIG. 1 is a schematic view of a simultaneous cooling and heating type multi-air conditioner according to the present invention.
Figure 2:
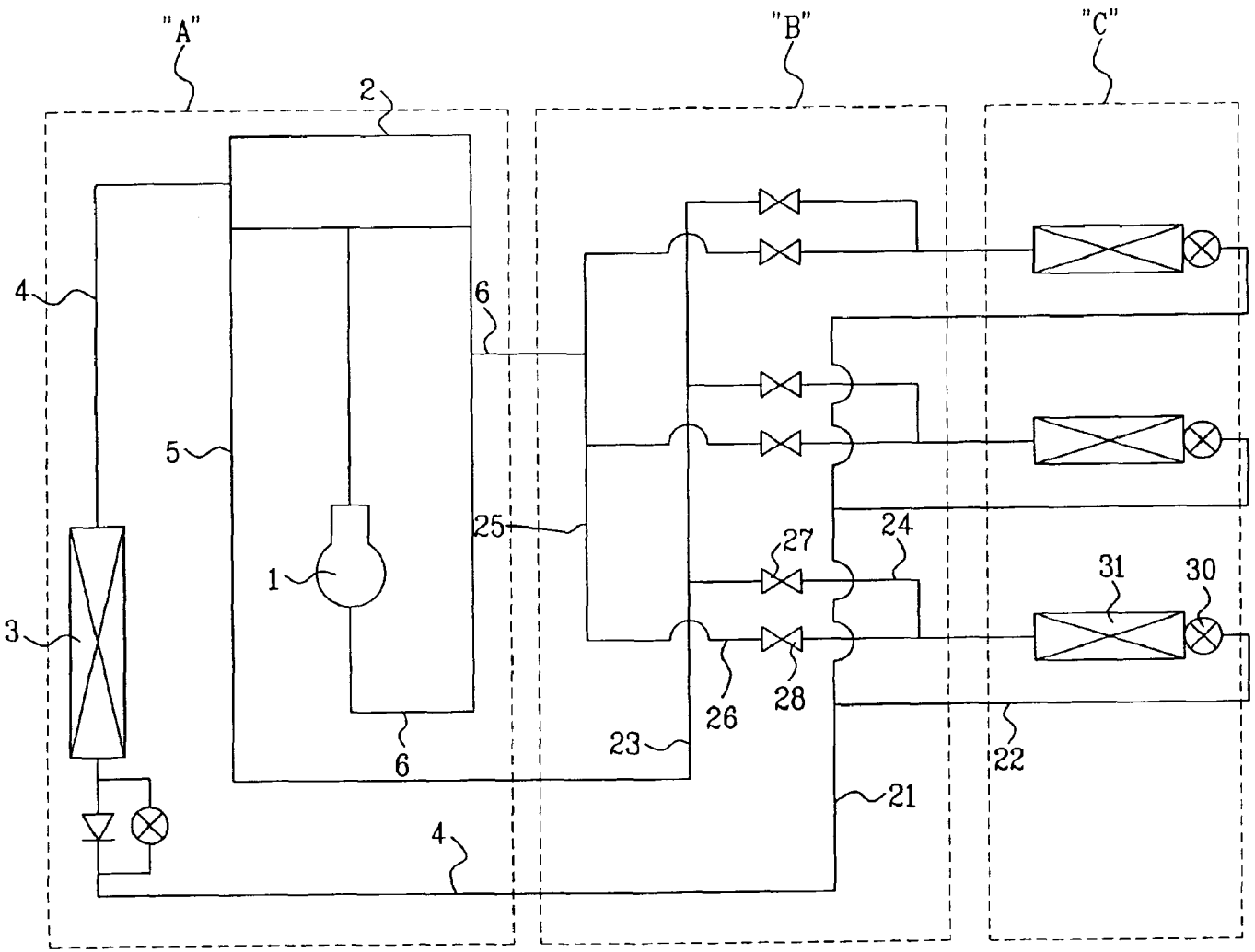
FIG. 2 is a construction view of a simultaneous cooling and heating type multi-air conditioner according to the present invention.

A schematic construction of the simultaneous cooling and heating type multi-air conditioner according to the present invention is shown in FIG. 1, and a whole construction thereof according to the present invention is shown in FIG. 2.

Referring to FIG. 1, the simultaneous cooling and heating type multi-air conditioner includes an outdoor unit (A) installed in an outdoor, for exchanging heat with the outdoor air; a plurality of indoor units (C) respectively installed in each of the indoor rooms and having a heat exchanger and an electronic expansion valve therein, for exchanging heat with an indoor air; and a distributor (B) installed between the outdoor unit and the indoor unit, for guiding a refrigerant.

On the other hand, the inventive multi-air conditioner can operate in a first mode in which indoor rooms all operate in the cooling mode, a second mode in which a majority of rooms operate in the cooling mode and a minority of rooms operate in the heating mode, a third mode in which the indoor rooms all operate in the heating mode, or a fourth mode in which the majority of rooms operate in the heating mode and the minority of rooms operate in the cooling mode.

The outdoor unit functions to compress the refrigerant and exchange heat with the outdoor unit. For this function, as shown in FIG. 2, the outdoor unit includes a compressor 1 for compressing the refrigerant; a refrigerant flow controller 2 for controlling a flow of the refrigerant compressed in the compressor according to the operation condition; an outdoor heat exchanger 3 connected with the refrigerant flow controller 2; and a pipe part for connecting structural elements to one another.

The pipe part of the present invention includes a first connection pipe 4 of which one end is connected to the refrigerant flow controller 2, the other end of which is connected to the distributor (B), and through which the outdoor heat exchanger 3 is connected therebetween; a second connection pipe 5 of which one end is connected with the refrigerant flow controller 2, for directly guiding a compressed refrigerant into the distributor (B) not via the outdoor heat exchanger 3; and a third connection pipe 6 through which an absorbing end of the compressor 1 is connected with the distributor (B) and through which a mid portion thereof is connected to the refrigerant flow controller 2 to guide the refrigerant into the compressor 1. In the drawings, reference numerals 4*a* and 4*b* respectively indicate a front part and a rear part of the first connection pipe 4.

Further, the refrigerant flow controller 2 is a unit for controlling a flow of the refrigerant depending on the operation condition. And, the refrigerant flow controller 2 includes a first auxiliary connection pipe 7*a* of which one end is connected with a discharging end of the compressor 1; a passage control unit 8 connected to the other end of the first auxiliary connection pipe 7*a* to convert the flow of the refrigerant flowed from the first auxiliary connection pipe 7*a* depending on the operation condition; and a second auxiliary connection pipe 7*b* of which one end is connected to the passage control unit 8 and the other end of which is connected with the first connection pipe 4; and a third auxiliary connection pipe 7c of which one end is connected to the passage control unit 8 and the other end of which is connected with a mid portion of a third connection pipe 6.

The passage control unit 8 of the refrigerant flow controller 2 performs a main function in controlling the refrigerant passage. This function can be performed in various manners, for example, in a manner of using an electronic valve for electronically controlling the flow of the refrigerant depending on the operation condition, and a manner of using a four-way valve constructed in an embodiment (FIG. 3) described later, etc.

On the other hand, the distributor (B) includes a guide pipe part for guiding the refrigerant through the first connection pipe 4 or the second connection pipe 5 of the outdoor unit (A), into the indoor unit (C), and for guiding the refrigerant flowed from the indoor unit (C), into the outdoor unit (A) via the first connection pipe 4 or the third connection pipe 6; and a valve part installed on the guide pipe part to control the flow of the refrigerant such that the refrigerant is selectively discharged from and introduced into the indoor unit according to the operation condition.

Further, the guide pipe part includes a high pressure/liquid-phase passage connected with the first connection pipe 4 to guide a high pressure/liquid-phase refrigerant between the indoor unit (C) and the outdoor unit (A); a high pressure/vapor-phase passage connected with the second connection pipe 5 to guide the high pressure/vapor-phase refrigerant between the indoor unit (C) and the outdoor unit (A); and a low pressure/vapor-phase passage connected with the third connection pipe 6 to guide the low pressure/vapor-phase refrigerant between the indoor unit (C) and the outdoor unit (A).

Furthermore, the high pressure/liquid-phase passage includes a high pressure/liquid-phase refrigerant connection pipe 21 directly connected with the first connection pipe 4 of the outdoor unit (A); and a high pressure/liquid-phase refrigerant branch pipe 22 of which one end is branched as many as the number of the indoor units from the high pressure/liquid-phase refrigerant connection pipe and the other end of which is connected with the electronic expansion valve 30 of each of the indoor units.

The high pressure/vapor-phase passage includes a high pressure/vapor-phase refrigerant connection pipe 23 directly connected with the second connection pipe 5 of the outdoor unit (A); and a high pressure/vapor-phase refrigerant branch pipe 24 of which one end is branched as many as the number of the indoor units from the high pressure/vapor-phase refrigerant connection pipe and the other end of which is connected with the heat exchanger 31 of each of the indoor units.

The low pressure/vapor-phase passage includes a low pressure/vapor-phase refrigerant connection pipe 25 directly connected with the third connection pipe 6 of the outdoor unit (A); and a low pressure/vapor-phase refrigerant branch pipe 26 of which one end is branched as many as the number of the indoor units from the low pressure/vapor-phase refrigerant connection pipe and the other end of which is connected with the heat exchanger 31 of each of the indoor units.

On the other hand, the valve part includes selection valves respectively installed on the high pressure/vapor-phase refrigerant branch pipe 24 and the low pressure/vapor-phase refrigerant branch pipe 26, for controlling the flow of the refrigerant such that, in case the indoor room operates in the cooling model, a valve 27 on the high pressure/vapor-phase refrigerant branch pipe 24 is closed and a valve 28 on the low pressure/vapor-phase refrigerant branch pipe 26 is opened, and in case the indoor room operates in the heating mode, each of the valves is opened and closed to the contrary.

The reference numeral 22 indicates 22*a*, 22*b* and 22*c*, the reference numeral 24 indicates 24*a*, 24*b* and 24*c*, the reference numeral 26 indicates 26*a*, 26*b* and 26*c*, the reference numeral 27 indicates 27*a*, 27*b* and 27*c*, the reference numeral 28 indicates 28*a*, 28*b* and 28*c*, the reference numeral 30 indicates 30*a*, 30*b* and 30*c*, and the reference numeral 31 indicates 31*a*, 31*b* and 31*c*.

Hereinafter, a preferred embodiment of the present invention will be described with reference to FIG. 3.

Since a basic construction of this embodiment is the same as in the above-descriptions, the same descriptions will be omitted and hereinafter, a characteristic construction, a connection relation thereof and an operation of this system will be described.

Figure 3:
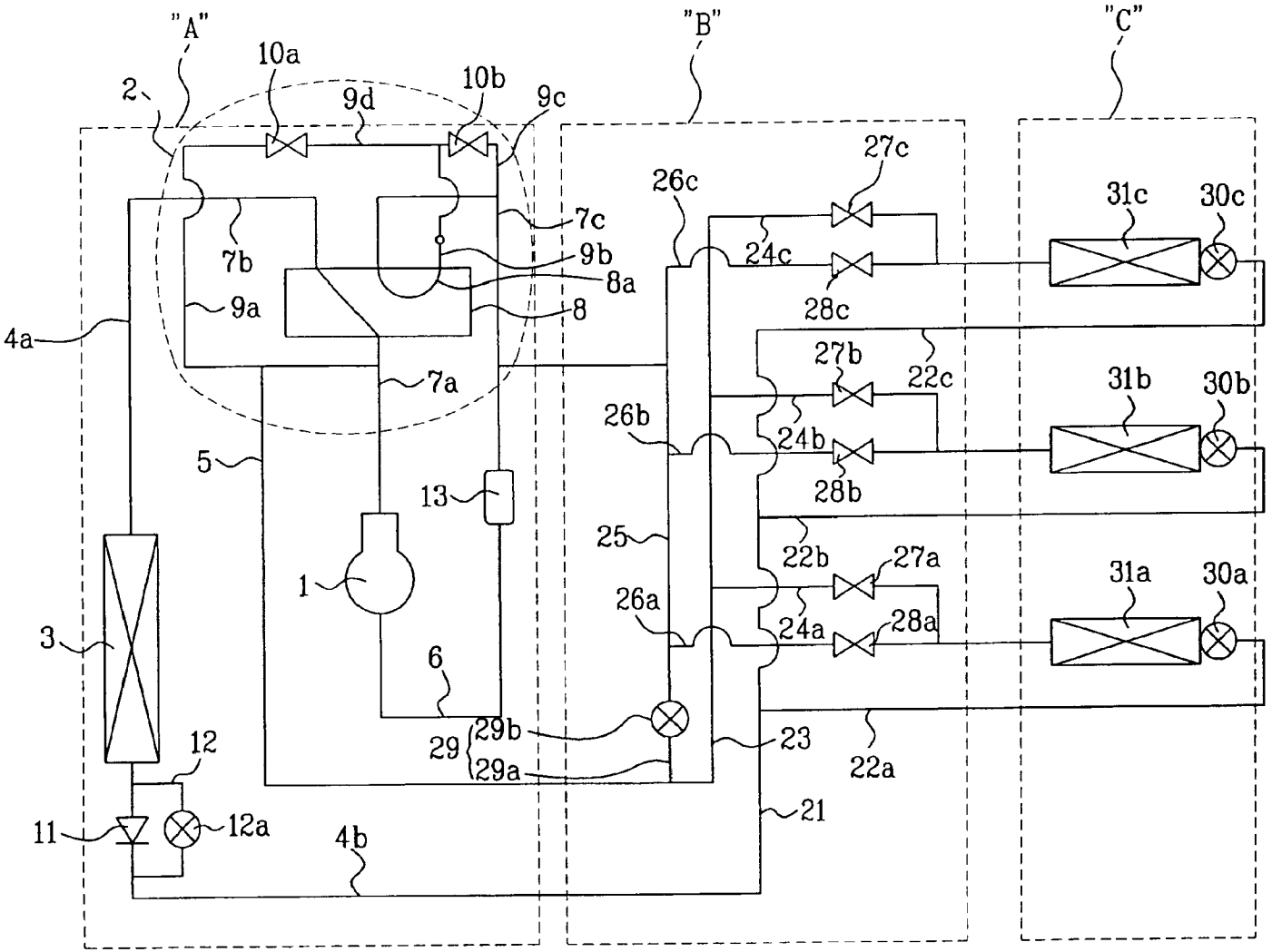
FIG. 3 is a detailed construction view of a simultaneous cooling and heating type multi-air conditioner according to an embodiment of the present invention.

As shown in FIG. 3, the passage control unit 8 includes an inner valve 8*a* for having the passage formed therein and converting a position thereof depending on the operation condition to guide the refrigerant.

On the other hand, the refrigerant flow controller 2 further includes a delay-preventive unit for performing an operation of the passage control unit 8 without any delay. The delay-preventive unit includes: a delay-preventive pipe 9*a* of which one end is connected to a mid portion of the second connection pipe 5; and a pressure-closing pipe 9*b* of which one end is connected to a mid portion of the delay-preventive pipe 9*a* and the other end of which is connected to the passage control unit 8 such that a predetermined amount of refrigerant is guided into the passage control unit 8 to keep pressurizing one side of the inner valve 8*a* and thus fix the inner valve 8*a*.

Additionally, the passage control unit 8 of the refrigerant flow controller 2 can be realized in the manner of using the four-way valve in which the second connection pipe 5 is connected to the mid portion of the first auxiliary connection pipe 7*a*.

More preferably, the delay-preventive unit includes an uniform pressure valve 10*a* installed on the delay-preventive pipe 9*a* to cut off a low pressure refrigerant and a high pressure refrigerant flowing through the delay-preventive pipe 9*a* thereby maintaining the refrigerant pressure at the time of operating in the first mode or the second mode; and a pressure-lowering auxiliary refrigerant flow pipe 9*c* of which one end is connected to the other end of the delay-preventive pipe 9*a* and the other end of which is connected to the mid portion of the third connection pipe 6 such that, when the third or fourth mode is converted into the first or second mode, the refrigerant pressure of the pressure-closing pipe 9*b* is reduced to allow the inner valve 8*a* to promptly move.

Additionally, the delay-preventive unit further includes an auxiliary uniform pressure valve 10*b* installed on a connection part of the auxiliary refrigerant flow pipe 9*c* and the delay-preventive pipe 9*a* such that, at the time of operating in the third or fourth mode, cut-off is made between the auxiliary refrigerant flow pipe 9*c* and the delay-preventive pipe 9*a* to respectively maintain the refrigerant pressure; and a rapid refrigerant flow pipe 9*d* installed between the uniform pressure valve 10*a* and the auxiliary uniform pressure valve 10*b* such that, when the first or second mode is converted into the third or fourth mode, the refrigerant is rapidly introduced into the pressure-closing pipe 9*b* to allow the inner valve 8*a* to rapidly move.

The delay-preventive unit has an advantage in which the conversion of the inner valve 8*a* is promptly performed without any delay, and can employ the electronic conversion manner in which the movement of the inner valve 8*a* is electronically controlled, not the mechanical conversion manner.

Meanwhile, the pipe part further includes a check valve 11 installed on the first connection pipe 4*b* of the distributor to allow the refrigerant to pass through the distributor only at the time of operating in the first or second mode; and a parallel expansion pipe 12 having an expansion element of the refrigerant and being installed in parallel with the check valve 11 to guide the refrigerant flowed from the distributor into the outdoor heat exchanger.

Preferably, as shown in FIG. 3, it is preferable that the expansion element on the parallel expansion pipe 12 is, at the time of operating in the third or fourth mode, comprised of a heating electronic expansion valve 12*a* for expanding the refrigerant introduced into the outdoor heat exchanger.

In another manner, the electronic expansion valve can be installed on the first connection pipe 4*b* such that, at the time of operating in the first or second mode, an opening of the electronic expansion valve is completely opened to allow the refrigerant to pass therethrough as it is and such that, at the time of operating in the third or fourth mode, the opening of the electronic expansion valve is controlled to expand the refrigerant.

In FIG. 3, the distributor (B) includes a liquefaction stop unit 29 installed between the second connection pipe 5 and the low pressure/vapor-phase refrigerant connection pipe 25 such that, at the time of operating in the first mode, the high pressure/vapor-phase refrigerant is prevented from being liquefied due to a stagnation.

Herein, the liquefaction stop unit 29 includes a bypass pipe 29*a* for connecting the second connection pipe 5 with the low pressure/vapor-phase refrigerant connection pipe 25 such that, at the time of operating in the first mode, the stagnated high pressure/vapor-phase refrigerant is bypassed; and an electronic conversion valve 29*b* installed on the bypass pipe 29*a* to convert the high pressure/vapor-phase refrigerant stagnated in the second connection pipe 5, into the low pressure/vapor-phase refrigerant.

Figure 10:
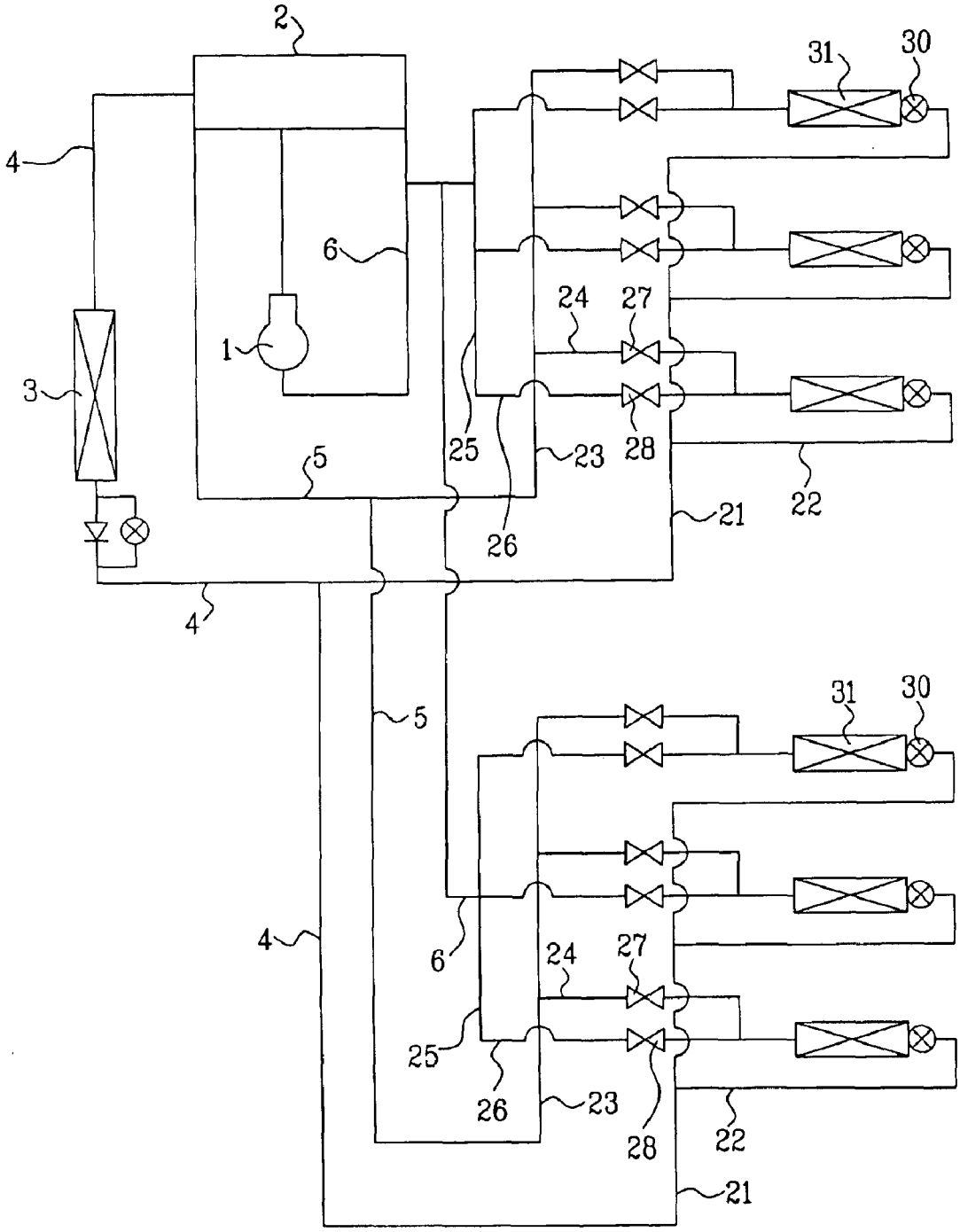
FIG. 10 is a detailed construction view of a simultaneous cooling and heating type multi-air conditioner according to another embodiment of the present invention.

Further, in the above embodiment, according to a width or a structure of the indoor, as shown in FIG. 10, the simultaneous cooling and heating multi-air conditioner can be also constructed having more than two distributors.

Hereinafter, an entire operation of the multi-air conditioner according to the above four operation modes will be described.

First, a first mode operation will be described with reference to FIGS. 4 and 8.

Figure 4:
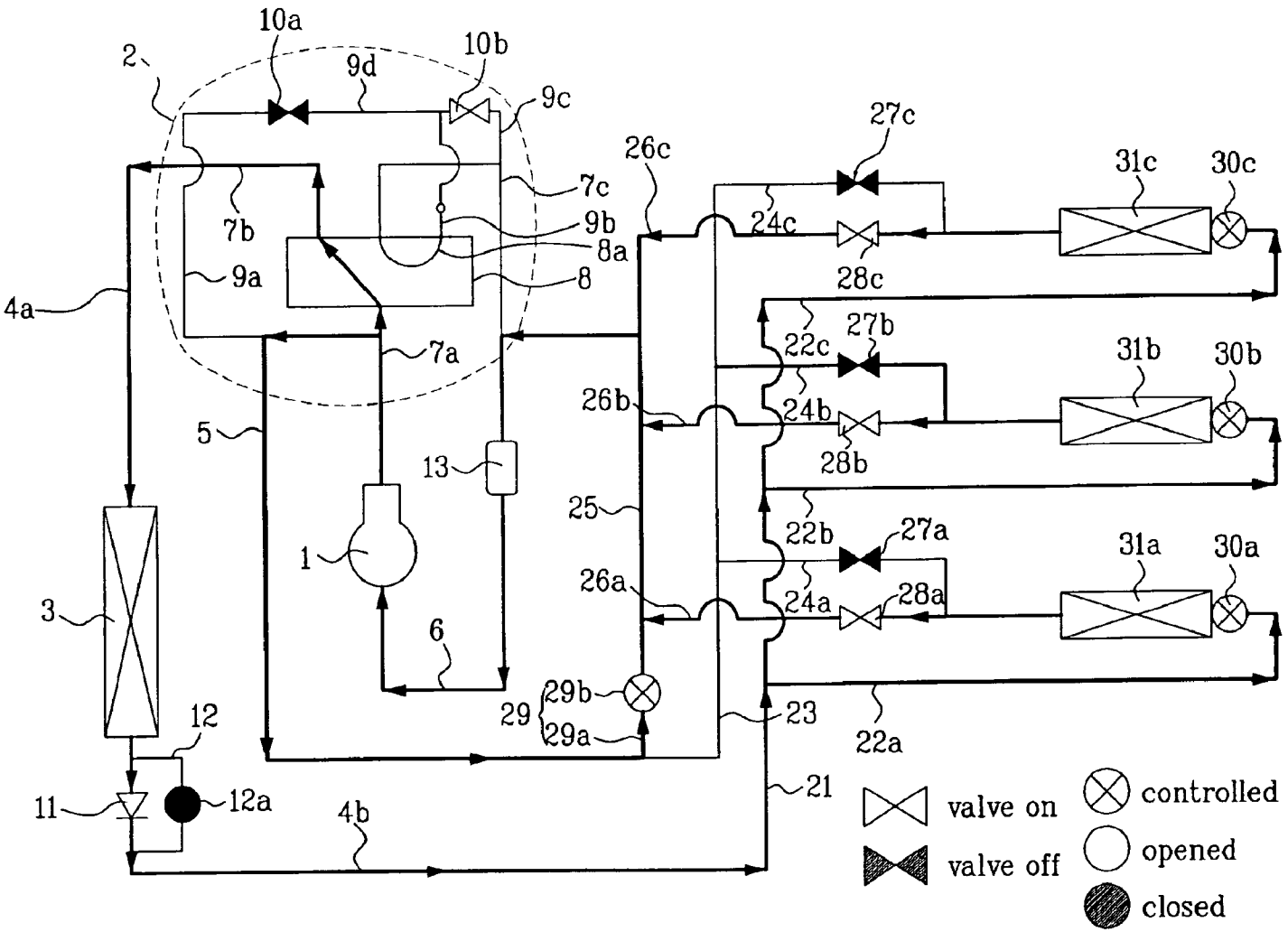
FIG. 4 is a view illustrating an operation state that a simultaneous cooling and heating type multi-air conditioner according to an embodiment of the present invention is operated in a first mode.

As shown in FIG. 4, most of the high pressure/vapor-phase refrigerant discharged from the compressor 1 is introduced into the four-way valve 8 via the first auxiliary connection pipe 7*a*. The introduced refrigerant is controlled by the inner valve 8*a* to be guided into the second auxiliary connection pipe 7*b*. A refrigerant control manner of the four-way valve 8 will be described after an entire flowchart of the second mode operation is described.

After the refrigerant is guided into the first connection pipe 4*a* via the second auxiliary connection pipe 7*b*, the guided refrigerant is introduced into the outdoor heat exchanger 3 to be heat-radiated therefrom. The refrigerant phase-converted into the high pressure/liquid-phase via the outdoor heat exchanger 3 is guided into the high pressure/liquid-phase refrigerant connection pipe 21 of the distributor via the check valve 11 and the first connection pipe 4*b*.

Next, the refrigerant passing through the high pressure/liquid-phase connection pipe 21 is guided into the high pressure/liquid-phase refrigerant branch pipe 22 branched into as many as the number of the outdoor units, and then is introduced into the electronic expansion valve 30 of the indoor unit. After the introduced high pressure/liquid-phase refrigerant is expanded, the expanded refrigerant passes through the indoor heat exchanger 31 while being under the heat absorption process to be converted into the low pressure/vapor-phase refrigerant.

After that, the low pressure/vapor-phase refrigerant passes through the low pressure/vapor-phase refrigerant branch pipe 26 of the distributor. This is because, as shown in FIG. 4, the selection valve 27 on the high pressure/vapor-phase refrigerant branch pipe 24 is closed and the selection valve 28 on the low pressure/vapor-phase refrigerant branch pipe 26 is opened. The selection valve is electronically controlled depending on the operation mode.

The refrigerant passing through the low pressure/vapor-phase refrigerant branch pipe 26 is gathered in the low pressure/vapor-phase refrigerant connection pipe 25 to be guided into the third connection pipe 6 of the indoor unit, and then is again absorbed in the compressor 1. A non-described reference numeral 13 of FIG. 4 indicates an accumulator.

On the other hand, a predetermined amount of refrigerant among the high pressure/vapor-phase refrigerant discharged from the compressor 1 is also introduced into the second connection pipe 5 connected to the first auxiliary connection pipe 7*a*. But, since the selection valve 27 on the high pressure/vapor-phase refrigerant branch pipe 24 of the distributor is closed, the introduced refrigerant no longer flows thereby being stagnated therein. However, the stagnated refrigerant is bypassed to the bypass pipe 29*a* of the liquefaction stop unit 29 installed between the second connection pipe 5 and the low pressure/vapor-phase refrigerant connection pipe 25, to be converted into the low pressure/vapor-phase refrigerant via the electronic conversion valve 29*b*.

The electronic conversion valve 29*b* is installed on the bypass pipe 29*a* to control an opening size thereof while converting the high pressure of vapor-phase refrigerant stagnated in the second connection pipe 5, into the low pressure/vapor-phase refrigerant, and then allows the converted refrigerant to be introduced into the low pressure/vapor-phase refrigerant connection pipe 25.

After the refrigerant is introduced into the low pressure/vapor-phase refrigerant connection pipe 25, the flow of the refrigerant is as described above.

Next, at the time of operating in the first or second mode, an operation of the refrigerant passage controller 2 having the four-way valve 8 will be described.

Figure 8:
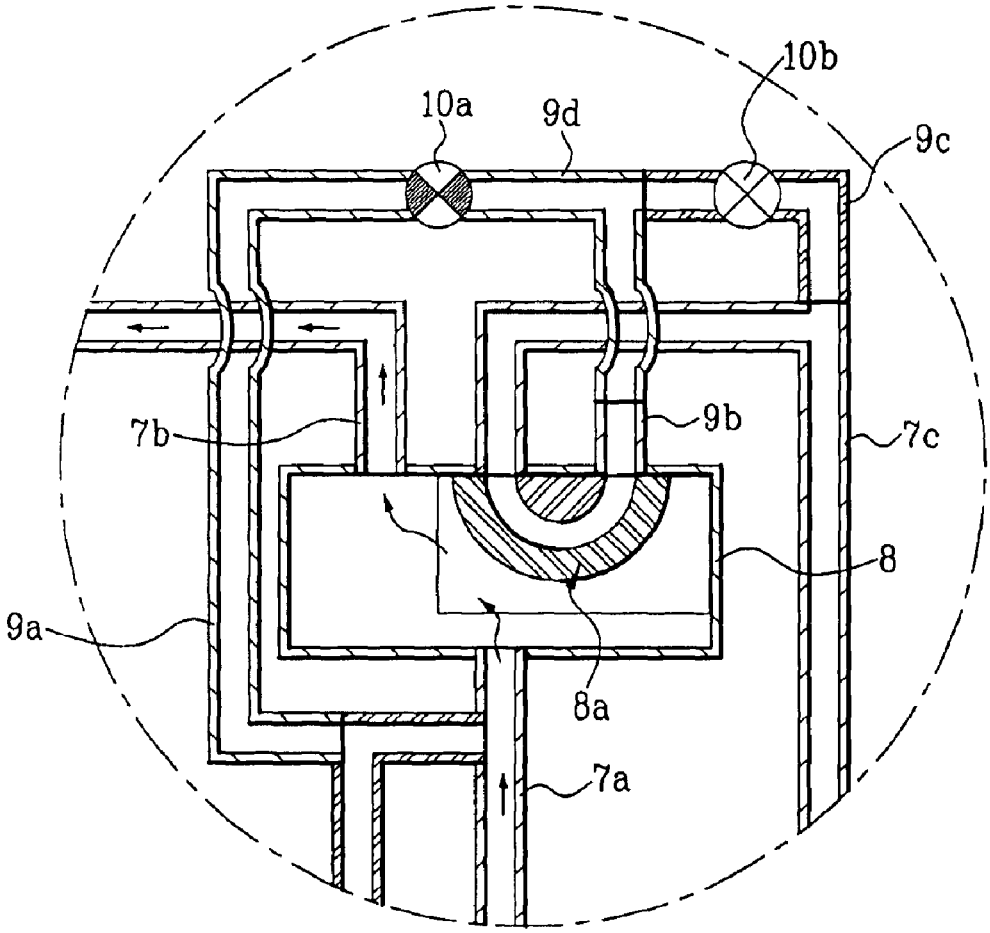
FIG. 8 is a detailed view illustrating an operation state of the refrigerant flow controller when a simultaneous cooling and heating type multi-air conditioner according to an embodiment of the present invention is operated in a first or second mode.

As shown in FIG. 8, in order to operate the four-way valve 8, after the delay-preventive unit first performs an initial process, the operation of the four-way valve is performed.

Figure 9:
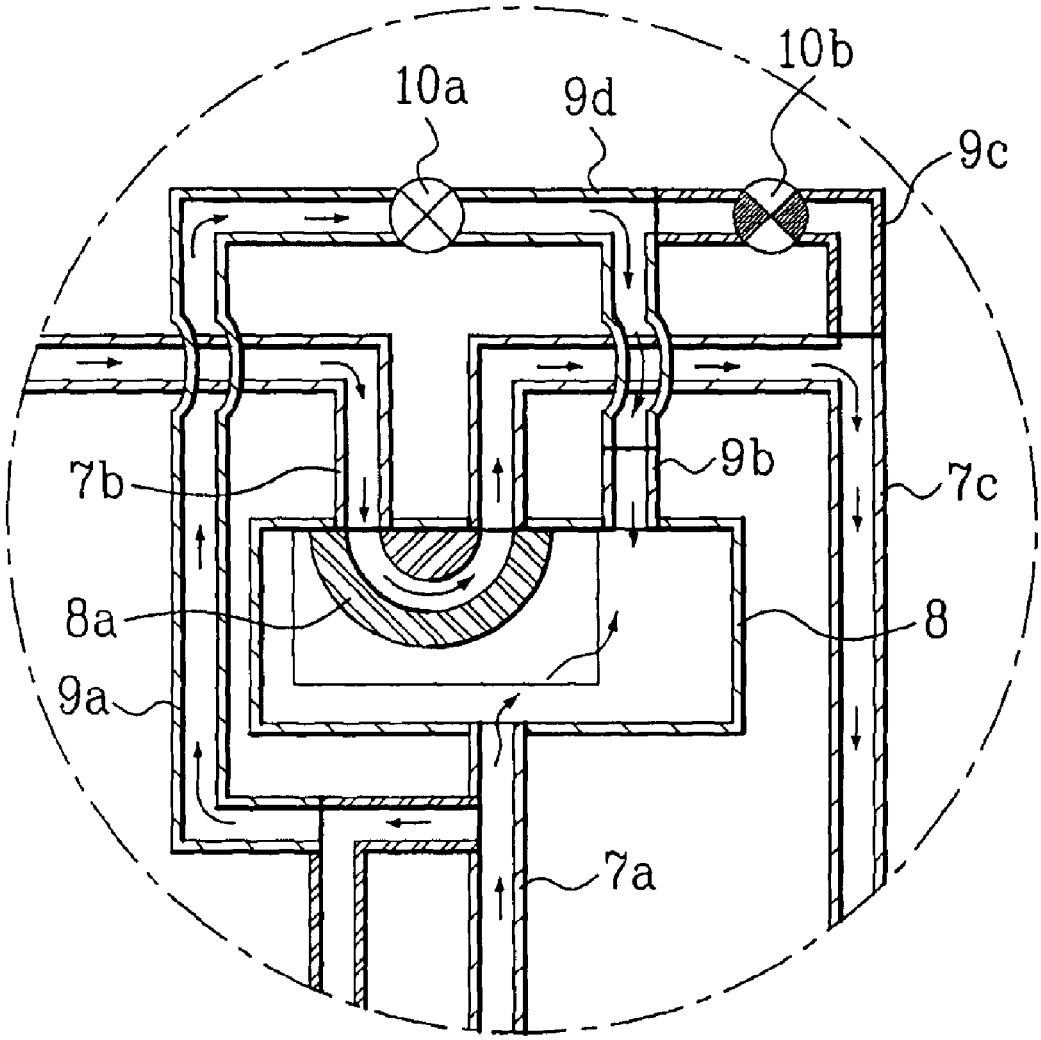
FIG. 9 is a detailed view illustrating an operation state of the refrigerant flow controller when a simultaneous cooling and heating type multi-air conditioner according to an embodiment of the present invention is operated in a third or fourth mode.

At an initial period during which the third or fourth mode is converted into the first or second mode, that is, At the initial period during which a state of FIG. 9 is converted into the state of FIG. 8, the uniform pressure valve 10*a* is closed and simultaneously the inner valve 8*a* is moved at a distance to the right side of the drawings by an electric force to disturb the refrigerant introduced into the four-way valve 8 from the first auxiliary connection pipe 7*a*, to the left side of the inner valve 8*a*.

At the same time, the high pressure/vapor-phase refrigerant stagnated in the pressure-closing pipe 9*b* is, at the same time of opening the auxiliary uniform pressure valve 10*b*, rapidly introduced into the pressure-lowering auxiliary refrigerant flow pipe 9*c* to rapidly reduce the pressure in the pressure-closing pipe 9*b*. By this, the refrigerant in the left side of the inner valve 8*a* is rapidly flowed out through the pressure-closing pipe 9*b*, and the pressure in the left side of the inner valve 8*a* is increased relatively more rapidly than the pressure applied to the right side thereof such that the inner valve 8*a* is rapidly moved to the right side.

If the inner valve 8*a* is entirely pushed closely to the right side, the high pressure/vapor-phase refrigerant discharged from the compressor 1 is introduced into the second auxiliary connection pipe 7*b* via the first auxiliary connection pipe 7*a* and the four-way valve 8 and resultantly is guided into the first connection pipe 4.

In the meanwhile, a portion of the high pressure/vapor-phase refrigerant introduced into the second connection pipe from the first auxiliary connection pipe 7*a* flows through the delay-preventive pipe 9*a*, but is cut off by the uniform pressure valve 10*a*. Accordingly, the refrigerant before and after the uniform pressure valve 10*a*, that is, the high pressure/vapor-phase refrigerant and the low pressure/vapor-phase refrigerant are not mixed.

As a result of an operation of the refrigerant flow controller 2, the first mode is operated.

Second, a second mode operation will be described with reference to FIG. 5.

In the second mode, since the operation of the refrigerant flow controller 2 is the same as the first mode operation, it will be omitted in the following description.

Figure 5:
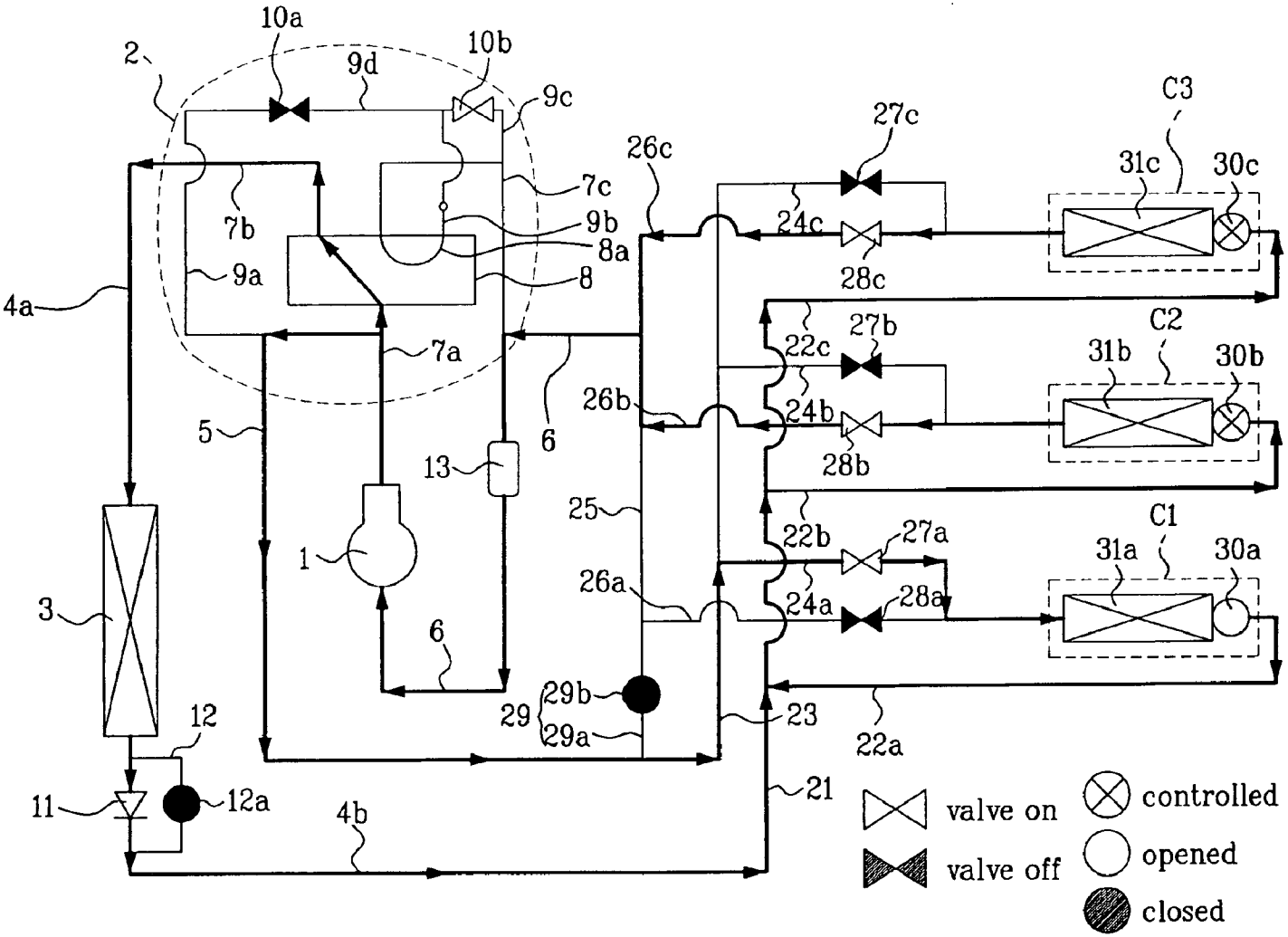
FIG. 5 is a view illustrating an operation state that a simultaneous cooling and heating type multi-air conditioner according to an embodiment of the present invention is operated in a second mode.

As shown in FIG. 5, most of high pressure/vapor-phase refrigerant discharged from the compressor 1 is introduced into the four-way valve by the first auxiliary connection pipe 7*a*. The introduced refrigerant is controlled by the inner valve 8*a* to be guided into the second auxiliary connection pipe 7*b*, and then passes through the first connection pipe 4. Since the afterward operation is the same as in the first mode, it will be omitted in the following description.

On the other hand, a small amount of refrigerant except for the high pressure/vapor-phase refrigerant introduced into the four-way valve 8 is guided through the second connection pipe 7*b*, and then is flowed out into the high pressure/vapor-phase connection pipe 23 of the distributor. In the second mode, differently from the first mode, the electronic conversion valve 29*b* of the liquefaction stop unit 29 is closed thereby not being introduced into the low pressure/vapor-phase refrigerant connection pipe 25.

Meanwhile, in the selection valve of the distributor connected to the room (C1) needing to operate in the heating mode, contrary to the rooms (C2, C3) needing to operate in the cooling mode, the selection valve 27*a* on the high pressure/vapor-phase refrigerant branch pipe 24*a* is opened and the selection valve 28*a* on the low pressure/vapor-phase refrigerant branch pipe 26*a* is closed such that the refrigerant passing through the high pressure/vapor-phase refrigerant connection pipe 23 is guided into the high pressure/vapor-phase refrigerant branch pipe 24*a* connected to the room (C1) needing to operate in the heating mode.

The refrigerant guided into the high pressure/vapor-phase refrigerant branch pipe 24*a* is introduced into the indoor heat exchanger 31*a* of the indoor unit needing to operate in the heating mode, to be heat-radiated therefrom, and then is flowed out into the high pressure/liquid-phase refrigerant branch pipe 22*a*.

The refrigerant guided through the high pressure/vapor-phase refrigerant branch pipe 24*a* is gathered and flowed together with the refrigerant passing through the outdoor heat exchanger 3 in the high pressure/liquid-phase refrigerant connection pipe 21. Additionally, the afterward process is the same as in the first mode.

Third, the third mode operation will be described with reference to FIGS. 6 and 9.

Figure 6:
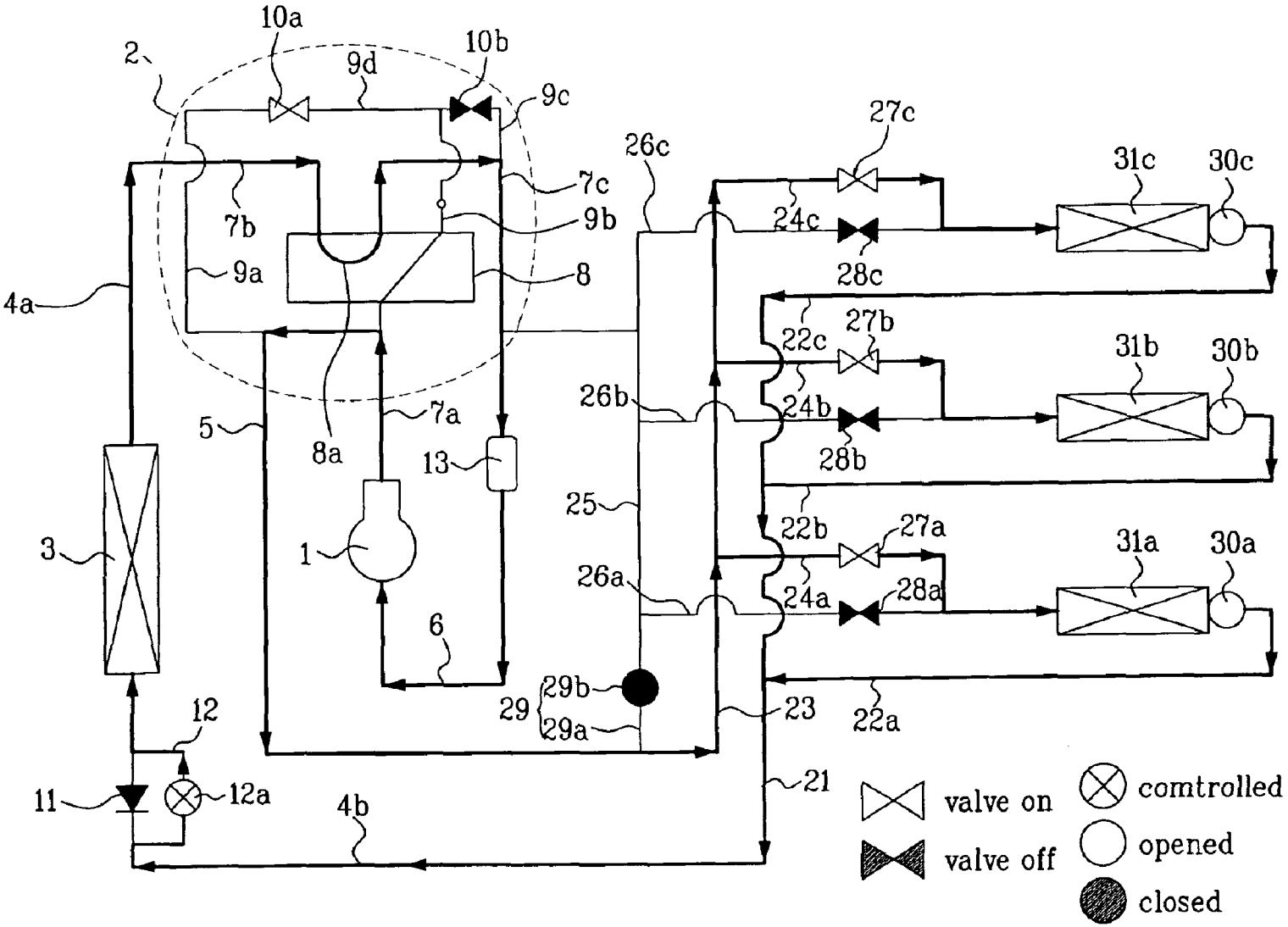
FIG. 6 is a view illustrating an operation state that a simultaneous cooling and heating type multi-air conditioner according to an embodiment of the present invention is operated in a third mode.

As shown in FIG. 6, most of the high pressure/vapor-phase refrigerant discharged from the compressor 1 is guided into the second connection pipe 5 via the first auxiliary connection pipe 7*a*. The introduced refrigerant is directly guided into the high pressure/vapor-phase refrigerant connection pipe 23 of the distributor. The refrigerant control manner of the four-way valve 8 will be described after an entire flowchart of the third mode operation is described.

On the other hand, the refrigerant guided into the high pressure/vapor-phase refrigerant connection pipe 23 is introduced into the high pressure/vapor-phase refrigerant branch pipe 24 branched into each of the indoor units. In the third mode, in the selection valve of the distributor electronically controlled, contrary to the first mode, the selection valve 27 on the high pressure/vapor-phase refrigerant branch pipe 24 is opened and the selection valve 28 on the low pressure vapor phase refrigerant branch pipe 26 is closed such that the refrigerant flows through the high pressure/vapor-phase refrigerant branch pipe 24 and then is introduced into the indoor heat exchanger 31 of the indoor unit to be under heat radiation process.

The high pressure/liquid-phase refrigerant flowed out from the indoor heat exchanger 31 is guided into the high pressure/liquid-phase refrigerant branch pipe 22 and the high pressure/liquid-phase refrigerant connection pipe 21 via the electronic expansion valve 30 entirely opened, and then is flowed through the first connection pipe 4*b* of the outdoor unit.

Next, the flowed refrigerant is introduced into the outdoor heat exchanger 3 via the electronic expansion valve 12*a* on the parallel pipe 12 installed in parallel with the check valve 11. This is because in the third mode, the check valve 11 is closed.

After that, the introduced refrigerant is, after the heat-absorption process, flowed out into the first connection pipe 4*a*, and then sequentially passes through the first connection pipe 4*a* and the second auxiliary connection pipe 7*b* to be introduced into the four-way valve 8. Next, the introduced refrigerant is guided into the third auxiliary connection pipe 7*c* via the inner valve 8*a* in the four-way valve 8. Further, the guided refrigerant is absorbed in the compressor 1 through the third connection pipe 6 connected to the third auxiliary connection pipe 7*c* to form an entire system.

Next, at the time of operating in the third or fourth mode, a description for an operation of the refrigerant flow controller 2 including the four-way valve 8 will be described.

As shown in FIG. 9, in order to operate the four-way valve 8, after the delay-preventive unit first performs an initial process, the four-way valve 8 is operated.

At an initial period during which the first or second mode is converted into the third or fourth mode, that is, at the initial period during which a state of FIG. 8 is converted into a state of FIG. 9, the auxiliary uniform pressure valve 10*b* is closed and at the same time, the inner valve 8*a* is moved at a distance to the left side of the drawing by the electric force to disturb the refrigerant introduced into the four-way valve 8 from the first auxiliary connection pipe 7*a*, to the right side of the inner valve 8*a*.

At the same time, the high pressure/vapor-phase refrigerant which is discharged from the compressor 1 while the uniform pressure valve 10*a* is opened, is rapidly introduced into the four-way valve 8 through the first auxiliary connection pipe 7*a* and the pressure-closing pipe 9*b* while the right side of the inner valve 8*a* is pressurized. By such pressurizing, the inner valve 8*a* is entirely rapidly pushed closely to the left side to maintain the pushed state, and passages of the second auxiliary connection pipe 7*b*, the inner valve 8*a* and the third auxiliary connection pipe 7*c* are connected to one another.

On the other hand, the auxiliary uniform pressure valve 10*b* is closed such that the high pressure/vapor-phase refrigerant discharged from the compressor 1 is not mixed with the low pressure/vapor-phase refrigerant absorbed in the compressor 1 to specify the second connection pipe 5 as a high pressure/vapor-phase area and the third connection pipe 6 as a low pressure/vapor-phase area.

As a result of the operation of the refrigerant flow controller 2, the third mode is operated.

Fourth, the fourth mode operation will be described with reference to FIG. 7.

In a fourth mode, since an operation of the refrigerant flow controller 2 is the same as in the third mode operation, it will be omitted in the following description.

Figure 7:
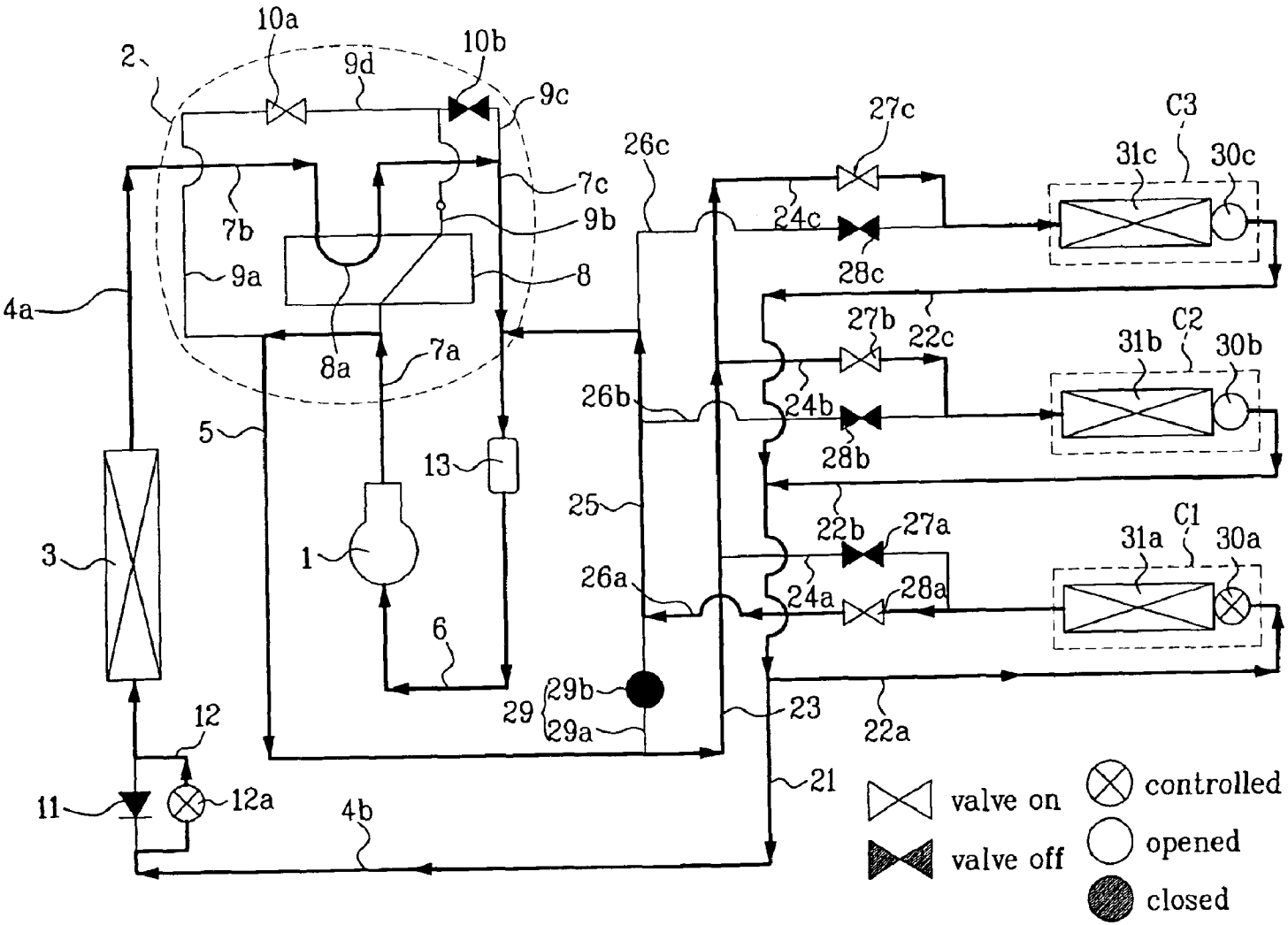
FIG. 7 is a view illustrating an operation state that a simultaneous cooling and heating type multi-air conditioner according to an embodiment of the present invention is operated in a fourth mode.

As shown in FIG. 7, most of the high pressure/vapor-phase refrigerant discharged from the compressor 1 is guided by the second connection pipe 5 to be introduced into the distributor. The introduced refrigerant passes through the high pressure/vapor-phase refrigerant connection pipe 23, and then is controlled by the selection valve of the distributor to be introduced through the high pressure/vapor-phase refrigerant branch pipe 24 into the indoor heat exchanger 31 included in the indoor unit of the rooms (C2, C3) needing to operate in the heating mode, to thereby be under the heat radiation process. Further, the heat-radiated refrigerant is guided through the high pressure/liquid-phase refrigerant branch pipe 22 and the high pressure/liquid-phase refrigerant connection pipe 21 via the electronic expansion valve 30 wholly opened.

Meanwhile, in the selection valve of the distributor connected to the room (C1) needing to operate in the cooling mode, contrary to the room needing to operate in the heating mode, the selection valve 27*a* on the high pressure/vapor-phase refrigerant branch pipe 24*a* is closed and the selection valve 28*a* on the low pressure/vapor-phase refrigerant branch pipe 26*a* is opened such that a predetermined amount of high pressure/liquid-phase refrigerant is guided among the refrigerant flowing through the high pressure/liquid-phase refrigerant connection pipe 21 into the high pressure/liquid-phase refrigerant branch pipe 22*a* connected to the room (C1) needing to operate in the cooling mode. Excepting a small amount of the high pressure/liquid-phase refrigerant guided into the high pressure/liquid-phase refrigerant branch pipe 22*a*, since the flow of the rest refrigerant is the same as in the third mode, it will be omitted in the following description.

Next, after the guided refrigerant is expanded in the electronic expansion valve 30*a* of the indoor unit needing to operate in the cooling mode, the expanded refrigerant is introduced into the indoor heat exchanger 31*a* to be under the heat absorption process, and then is flowed out into the low pressure/liquid-phase refrigerant branch pipe 26*a* having the passage opened by the selection valve 28*a*.

After that, the low pressure/vapor-phase refrigerant passes through the low pressure/vapor-phase refrigerant connection pipe 25, and then is gathered together with the refrigerant passing through the outdoor heat exchanger 3 in a cross part of the third auxiliary connection pipe 7*c* and the third connection pipe 6 to be absorbed in the compressor 1.

Meanwhile, the inventive multi-air conditioner has an advantage in installation since a plurality of distributors can be constructed according to the width or the structure of the indoor space. Since the connection relation of each of the plurality of distributors is the same as that of one distributor, it will be omitted in the following description.

Summarizing the effects of the present invention constructed as described above is as follows.

First, the multi-air conditioner according to the present invention has an advantage of being capable of responding to an environment of each room optimally. That is, the inventive multi-air conditioner is capable of operating all in a first mode in which each of the rooms all operate in the cooling mode; a second mode in which the majority of rooms operate in the cooling mode and the minority of rooms operate in the heating mode; a third mode in which each of the rooms all operate in the heating mode; and a fourth mode in which the majority of rooms operate in the heating mode and the minority of rooms operate in the cooling mode.

Second, the inventive multi-air conditioner can reduce a manufacture cost and simplify a manufacture process since the number of the pipe of the outdoor unit is simplified to three.

Third, the inventive multi-air conditioner can prevent the pipe diameter from being excess-designed since a specific pressure and phase of refrigerant flows through each of the connection pipes regardless the operation condition.

Fourth, in case the inventive multi-air conditioner further includes the delay-preventive unit, the conversion of the inner valve is promptly performed by a pressure difference in the four-way valve at the time of conversion of the operation mode.

Fifth, in case the inventive multi-air conditioner further includes the liquefaction stop unit, at the time of operating in the first mode, since the high pressure/vapor-phase refrigerant stagnated in the second connection pipe of the outdoor unit is not liquefied and is introduced into the low pressure/vapor-phase refrigerant, a shortage of the refrigerant can be prevented.

Sixth, the inventive multi-air conditioner has an advantage in installation since the plurality of distributors can be constructed according to the width or the structure of the indoor space.

Seventh, the inventive multi-air conditioner does not need a pressure controlling unit individually, though the plurality of distributors are provided, to thereby have advantages of a construction simplification, a simplification of the manufacture process, a reduction of the manufacture cost, and an easy installation.

It will be apparent to those skilled in the art that various modifications and variations can be made in the present invention. For example, the noise suppressing apparatus may be installed at the refrigerant pipe of the outdoor unit, as well as the indoor unit. Also, a number of comparting plates are not integrally formed with the body, but is separately inserted and fixed to the body. Thus, it is intended that the present invention covers the modifications and variations of this invention provided they come within the scope of the appended claims and their equivalents.

What is claimed is:

1. A multi-air conditioner comprising:

an outdoor unit installed at an outdoor location, and having therein a compressor, a refrigerant flow controller connected to a discharge outlet of the compressor and being configured to guide refrigerant according to an operation condition, an outdoor heat exchanger connected with the refrigerant flow controller, and at least flow controller and the heat exchanger being connected by piping;

a plurality of indoor units installed at respective indoor rooms and provided with an indoor heat exchanger having one end connected with a distributor, and an electronic expansion valve having one end connected to the indoor heat exchanger and another end connected with the distributor; and the distributor being positioned between the outdoor unit and the indoor units and being configured to, selectively guide the refrigerant introduced from the outdoor unit to the plurality of indoor units according to the operation condition and to guide the refrigerant passing through the indoor units, to the outdoor unit, the piping including a first connection pipe having one end connected to the refrigerant flow controller, the other end connected to the distributor, and an outdoor heat exchanger is connected between the one end and the other end of the first connection pipe, a second connection pipe of having one end connected with the refrigerant flow controller and being configured to guide the compressed refrigerant to the distributor, and a third connection pipe connecting a suction inlet of the compressor with the distributor and having a mid portion connected to the refrigerant flow controller and being configured to guide a low pressure/vapor-phase refrigerant to the compressor.

2. The multi-air conditioner of claim 1, wherein the operation condition comprises:

a first mode in which all the indoor rooms are operated in a cooling mode;

a second mode in which a majority of indoor rooms are operated in the cooling mode and a minority of indoor rooms are operated in a heating mode;

a third mode in which all the indoor rooms are operated in the heating mode; and a fourth mode in which a majority of indoor rooms are operated in the heating mode and a minority of indoor rooms are operated in the cooling mode.

3. The multi-air conditioner of claim 2, wherein the refrigerant flow controller comprises:

a first auxiliary connection pipe with one end connected to the discharge outlet of the compressor;

a passage control unit with one end connected to the other end of the first auxiliary connection pipe, the passage control unit changing the flow of the refrigerant introduced from the first auxiliary connection pipe according to the operation condition;

a second auxiliary connection pipe with one end connected to the passage control unit and the other end connected to the first connection pipe; and a third auxiliary connection pipe with one end connected to the passage control unit and the other end connected to the mid portion of the third connection pipe.

4. The multi-air conditioner of claim 3, wherein the passage control unit comprises an electronic valve for controlling the flow of the refrigerant by electronic control according to the operation condition.

5. The multi-air conditioner of claim 3, wherein the passage control unit guides the refrigerant by changing position according to the operation condition, and comprises an inner valve having a flow passage formed therein.

6. The multi-air conditioner of claim 5, wherein the refrigerant flow controller further comprises a delay-preventive unit for allowing the operation of the passage control unit to be performed without a delay.

7. The multi-air conditioner of claim 6, wherein the delay-preventive unit comprises:

a delay-preventive pipe with one end connected to a mid portion of the second connection pipe; and a pressure-closing pipe with one end connected to the other end of the delay-preventive pipe and the other end connected with the passage control unit, the pressure-closing pipe guiding a predetermined amount of the refrigerant to an inside of the passage control unit to fix the inner valve such that one side of the inner valve is continuously pressed during the operation of the third or fourth mode.

8. The multi-air conditioner of claim 7, wherein the second connection pipe connected to the mid portion of the first auxiliary connection pipe of the refrigerant flow controller, and the passage control unit comprises a four-way valve.

9. The multi-air conditioner of claim 8, wherein the delay-preventive unit comprises:

a uniform pressure valve provided on the delay-preventive pipe, for cutting off a low/high pressure refrigerant flowing through the delay-preventive pipe to maintain the pressures of the refrigerant respectively at predetermined levels, during the operation in the first or second mode; and a pressure-lowering auxiliary refrigerant flow pipe with one end connected to the other end of the delay-preventive pipe and the other end connected with the mid portion of the third connection pipe, the pressure-lowering auxiliary refrigerant flow pipe lowering the refrigerant pressure of the pressure-closing pipe such that the inner valve rapidly moved when the operation converted from the third or fourth mode to the first or second mode.

10. The multi-air conditioner of claim 9, wherein the delay-preventive unit comprises:

an auxiliary uniform pressure valve provided on a connection part of the auxiliary refrigerant flow pipe and the delay-preventive pipe, the auxiliary uniform pressure valve cutting off a space between the auxiliary refrigerant flow pipe and the delay-preventive pipe to maintain the pressures of the refrigerants respectively at predetermined levels, during the operation of the first or second mode; and a rapid refrigerant flow pipe provided between the uniform pressure valve and the auxiliary uniform pressure valve, for rapidly introducing the refrigerant into the pressure closing pipe such that the inner valve is rapidly moved when the operation is converted from the first or second mode to the third or fourth mode.

11. The multi-air conditioner of claim 10, wherein the pipe part comprises:

a check valve installed on the first connection pipe adjacent to the distributor, for passing the refrigerant only during the first or second mode of operation; and a parallel expansion valve installed in parallel with the check valve, for guiding the refrigerant introduced from the distributor to the outdoor heat exchanger only during the third or fourth mode operation, the parallel expansion valve including an element for expanding the refrigerant.

12. The multi-air conditioner of claim 11, wherein the expansion valve includes a parallel expansion pipe and further comprises a heating electronic expansion valve for expanding the refrigerant introduced into the outdoor heat exchanger during the third or fourth mode of operation.

13. The multi-air conditioner of claim 12, wherein the distributor comprises:

a high pressure/liquid-phase refrigerant connection pipe with one end connected with the first connection pipe of the outdoor unit;

high pressure/liquid-phase refrigerant branch pipes having one end branched from the high pressure/liquid-phase refrigerant connection pipe according to the number of the indoor units, and the other end connected to the electronic expansion valve of each of the indoor units;

a high pressure/vapor-phase refrigerant connection pipe with one end connected with the second connection pipe of the outdoor unit;

high pressure/vapor-phase refrigerant branch pipes having one end branched from the high pressure/vapor-phase refrigerant connection pipe according to the number of the indoor units, and the other end connected with the heat exchanger of each of the indoor units;

a low pressure/vapor-phase refrigerant connection pipe with one end connected with the third connection pipe of the outdoor unit;

low pressure/vapor-phase refrigerant branch pipes having one end which is branched from the low pressure/vapor-phase refrigerant connection pipe according to the number of the indoor units, and the other end connected with the heat exchanger of each of the indoor units; and selection valves respectively installed on the high pressure/vapor-phase refrigerant branch pipe and the low pressure/vapor-phase refrigerant branch pipe, for controlling the flow of the refrigerant such that when the indoor room operates in the cooling mode, a valve on the high pressure/vapor-phase refrigerant branch pipe is closed and a valve on the low pressure/vapor-phase refrigerant branch pipe is open, and when the indoor room operates in the heating mode, each of the valves is oppositely open and closed.

14. The multi-air conditioner of claim 13, further comprising a liquefaction stop unit installed between the second connection pipe and the low pressure/vapor-phase refrigerant connection pipe, for preventing the high pressure/vapor-phase refrigerant from being liquefied due to stagnation during the first mode of operation.

15. The multi-air conditioner of claim 14, wherein the liquefaction stop unit comprises:

a bypass pipe connecting the second connection pipe with the low pressure/vapor-phase refrigerant connection pipe, for bypassing the stagnated high pressure/vapor-phase refrigerant during the first mode of operation; and an electronic conversion valve installed on the bypass pipe, for converting the high pressure/vapor-phase refrigerant stagnated in the second connection pipe, into the low pressure/vapor-phase refrigerant.

16. The multi-air conditioner of claim 15, wherein the electronic expansion valve of the indoor unit guides, in the heating operation, the refrigerant from the indoor heat exchanger to the high pressure/liquid-phase refrigerant branch pipe without an expansion by fully opening an opening of the electronic expansion valve, and guides, in the cooling operation, the refrigerant from the high pressure/liquid-phase refrigerant branch pipe to the indoor heat exchanger by adjusting the opening thereof to expand the refrigerant.

17. The multi-air conditioner of claim 16, wherein the distributor comprises at least one distributor installed according to an installation condition of each of the indoor units.

18. The multi-air conditioner of claim 13, wherein the distributor comprises at least one distributor installed according to an installation condition of each of the indoor units.

19. The multi-air conditioner of claim 16, wherein the refrigerant flows through rear part of the first connection pipe, the second connection pipe, the third connection pipe and each of the guide pipe of the distributor at equal state and pressure regardless of the operation condition.

20. The multi-air conditioner of claim 2, wherein the piping comprises:

a check valve installed on the first connection pipe adjacent to the distributor, for passing the refrigerant toward the distributor only during the first or second mode of operation; and a parallel expansion pipe including a parallel expansion element installed in parallel with the check valve, the parallel expansion pipe guiding the refrigerant introduced from the distributor to the outdoor heat exchanger only during the third or fourth mode of operation, said parallel expansion element including an element for expanding the refrigerant.

21. The multi-air conditioner of claim 20, wherein the expansion element on the parallel expansion pipe further comprises a heating electronic expansion valve, for expanding the refrigerant introduced into the outdoor heat exchanger during the third or fourth mode of operation.

22. The multi-air conditioner of claim 2, wherein the distributor comprises:

a guide pipe for guiding the refrigerant introduced through the first or second connection pipe of the outdoor unit to the indoor units according to the operation mode and guiding the refrigerant introduced from the indoor units to the outdoor unit through the first or third connection pipe; and a valve installed on the guide pipe, for controlling a flow of the refrigerant such that the refrigerant is selectively introduced into the respective indoor units according to the operation condition.

23. The multi-air conditioner of claim 22, wherein the guide pipe comprises:

a high pressure/liquid-phase passage connected with the first connection pipe, for guiding a high pressure/liquid-phase refrigerant between the indoor units and the outdoor unit;

a high pressure/vapor-phase passage connected with the second connection pipe, for guiding a high pressure/vapor-phase refrigerant between the indoor units and the outdoor unit; and a low pressure/vapor-phase passage connected with the third connection pipe, for guiding a low pressure/vapor-phase refrigerant between the indoor units and the outdoor unit.

24. The multi-air conditioner of claim 23, wherein the guide pipe comprises:

a high pressure/liquid-phase refrigerant connection pipe with one end connected with the first connection pipe of the outdoor unit;

high pressure/liquid-phase refrigerant branch pipes having one end branched from the high pressure/liquid-phase refrigerant connection pipe according to the number of the indoor units, and the other end connected with an electronic expansion valve of each of the indoor units;

a high pressure/vapor-phase refrigerant connection pipe with one end connected to the second connection pipe of the outdoor unit;

high pressure/vapor-phase refrigerant branch pipes having one end branched from the high pressure/vapor-phase refrigerant connection pipe according to the number of the indoor units, and the other end connected to the heat exchanger of each of the indoor units;

a low pressure/vapor-phase refrigerant connection pipe with one end connected to the third connection pipe of the outdoor unit; and low pressure/vapor-phase refrigerant branch pipes having one end branched from the low pressure/vapor-phase refrigerant connection pipe according to the number of the indoor units, and the other end connected to the heat exchanger of each of the indoor units.

25. The multi-air conditioner of claim 24, wherein the distributor further comprises a liquefaction stop unit installed between the second connection pipe and the low pressure/vapor-phase refrigerant connection pipe, for preventing the high pressure/vapor-phase refrigerant from being liquefied due to a stagnation during the first mode of operation.

26. The multi-air conditioner of claim 25, wherein the liquefaction stop unit comprises:

a bypass pipe connecting the second connection pipe with the low pressure/vapor-phase refrigerant connection pipe, for bypassing the stagnated high pressure/vapor-phase refrigerant during the first mode of operation; and an electronic conversion valve on the bypass pipe, for converting the high pressure/vapor-phase refrigerant stagnated in the second connection pipe into the low pressure/vapor-phase refrigerant.

27. The multi-air conditioner of claim 25, wherein the valve comprises selection valves respectively installed on the high pressure/vapor-phase refrigerant branch pipe and the low pressure/vapor-phase refrigerant branch pipe, for controlling the flow of the refrigerant such that when the indoor room operates in the cooling mode, a valve on the high pressure/vapor-phase refrigerant branch pipe is closed and a valve on the low pressure/vapor-phase refrigerant branch pipe is open, and when the indoor room operates in the heating mode, each of the valves is oppositely open and closed.

28. The multi-air conditioner of claim 27, wherein the electronic expansion valve of the indoor unit guides, in the heating mode of operation, the refrigerant from the indoor heat exchanger to the high pressure/liquid-phase refrigerant branch pipe without an expansion by fully opening an opening thereof, and guides, in the cooling operation, the refrigerant from the high pressure/liquid-phase refrigerant branch pipe to the indoor heat exchanger by adjusting the opening to expand the refrigerant.

29. The multi-air conditioner of claim 27, wherein the distributor comprises at least one distributor installed according to an installation condition of each of the indoor units.

30. The multi-air conditioner of claim 22, wherein the refrigerant flows through rear part of the first connection pipe, the second connection pipe, the third connection pipe and each of the guide pipe of the distributor at equal state and pressure regardless of the operation condition.

* * * * *

UNITED STATES PATENT AND TRADEMARK OFFICE

CERTIFICATE OF CORRECTION

PATENT NO. : 6,880,356 B2
DATED : April 19, 2005
INVENTOR(S) : J. H. Park et al.

It is certified that error appears in the above-identified patent and that said Letters Patent is hereby corrected as shown below:

Column 15,
Line 39, after “least” insert -- the --.
Line 48, after “to” delete “,”.

Column 16,
Line 53, after “valve” insert -- is --.

Column 17,
Line 4, after “valve” insert -- is --; and after “operation” insert -- is --.

Signed and Sealed this

Thirteenth Day of December, 2005

JON W. DUDAS
*Director of the United States Patent and Trademark Office*